United States Patent [19]

DeLuca et al.

[11] 4,203,562

[45] May 20, 1980

[54] FLEXIBLE SHEET MATERIAL DISPENSING OF ROLLS IN SUCCESSION

[75] Inventors: Raymond F. DeLuca, Stamford, Conn.; Gene Schwemm, East Dundee, Ill.

[73] Assignee: Georgia-Pacific Corporation, Portland, Oreg.

[21] Appl. No.: 831,417

[22] Filed: Sep. 8, 1977

[51] Int. Cl.[2] ..... A47K 10/38

[52] U.S. Cl. ..... 242/55.3; 242/55.53; 242/58; 312/39

[58] Field of Search ..... 242/55.3, 55.53, 55.42, 242/58; 312/39, 40, 38

[56] References Cited

U.S. PATENT DOCUMENTS

| | | | |
|---|---|---|---|
| 3,061,218 | 10/1962 | Moore | 242/55.3 |
| 3,294,329 | 12/1966 | Tucker et al. | 242/55.3 |
| 3,381,909 | 5/1968 | Tucker et al. | 242/55.3 |
| 3,387,902 | 6/1968 | Perrin et al. | 242/55.53 |
| 3,572,600 | 3/1971 | Jespersen | 242/55.53 |
| 3,650,487 | 3/1972 | Bahnsen | 242/55.3 |
| 3,771,739 | 11/1973 | Nelson | 242/55.3 |

*Primary Examiner*—George F. Mautz

*Attorney, Agent, or Firm*—Schuyler, Birch, McKie & Beckett

[57] ABSTRACT

A dispenser for flexible sheet material to carry multiple rolls of material such as paper toweling with dispensing mechanism being provided to lead a web of material out of the dispenser to the user. While one roll is in an initial dispensing position a reserve roll is held latched in a reserve non-dispensing position with the latching being released by cam means upon sensing that the one rolls is substantially depleted of sheet material whereupon the reserve roll moves to be driven in relation to the initial roll. While the remaining sheet material on the initial roll is withdrawn from the dispenser by the user the leading end of the sheet material on the reserve roll joins with such remaining sheet material to be led through said dispensing mechanism to be available to the user when the remaining sheet material on the initial roll is exhausted.

17 Claims, 9 Drawing Figures

FLEXIBLE SHEET MATERIAL DISPENSING OF ROLLS IN SUCCESSION

BACKGROUND OF THE INVENTION

1. Field of the Invention

This invention relates to dispensers and more specifically to a dispenser for handling multiple rolls of flexible sheet material such as paper toweling to be dispensed in succession.

2. The Prior Art

Dispensers for rolls of flexible sheet material such as paper toweling have been known in the prior art for sometime. Indeed, dispensers holding a multiple of such flexible material rolls have been known where at least one reserve roll is held in a non-dispensing position while sheet material from an initial roll is being dispensed to the user. These multiple roll dispensers include mechanism to move the reserve roll into a dispensing position when the initial roll of material is depleted.

The flexible sheet material may be led from the dispenser to be supplied to the user by a number of different means usually incorporating at least a pair of rolls between which the sheet material passes. The sheet material may be manually withdrawn by the user and manually torn off against a serrated cutting blade mounted near the sheet outlet of the dispenser, a manually operated crank may drive the rolls to feed out the sheet material to be cut off by being drawn against such a serrated blade, the dispenser may have a rotatably mounted knife within the dispenser cooperating with a slot in a rotatable roller adjacent the knife for the sheet material to be severed or perforated to be more easily torn off. Many dispensers for flexible sheet material include means to measure a desired length of the web dispensed to the user to control the length of web, such as paper toweling, dispensed on each operation of the dispenser.

Aside from whatever type of mechanism may be employed in guiding the web of sheet material from the roll and out of the dispenser, in multiple roll dispensers a problem is encountered in effectively and reliably getting the leading end of sheet material on the reserve roll to feed into the dispensing mechanism when the reserve roll moves into its dispensing position, after depletion of the initial roll, and the reserve roll's sheet material is to be fed from the dispenser to the user. The solution to this problem has been approached in a number of different ways. Many have been found ineffective to assure that the sheet material on the reserve roll is reliably picked-up by the dispensing mechanism so that the web of material is made available on the exterior of the dispenser to the user. The prior art dispensers have gone to rather complicated and expensive structures to get the leading end of sheet material on a reserve roll into the dispensing mechanism thus, aside from the expense of their manufacture, also contributing to more costly maintenance and a tendency to fail or breakdown.

SUMMARY OF THE INVENTION

The present invention involves dispensing sheet material from multiple rolls in succession in a manner which solves the above-mentioned problems present in the prior art, doing so by way of a relatively simple construction and approach to assure that the leading end of the sheet material on the reserve roll will be picked up by the dispensing mechanism and effectively be led to the dispenser's exterior for accessibility to the user.

In the instant invention, an initial roll of sheet material is rotatably carried within the dispenser with a web of the material leading through the dispensing mechanism to the exterior for removal by the user. A second or reserve roll of sheet material is held in a reserve position which retains it spaced from the initial roll and inoperative for sheet material dispensing therefrom but yet held in readiness to be available on substantial depletion of the sheet material on the initial roll. This reserve roll is latched in the reserve position. The degree of depletion of the sheet material on the initial roll as the web of sheet material is advanced and removed from the initial roll is sensed. The sensing of substantial depletion acts to release the latching of the reserve roll to permit it to move to a dispensing position operative for sheet material removal from such roll. The releasing of the latching is effected in response to sensed near depletion of the initial roll causing camming of the latch from its latched condition to an unlatched condition thereby releasing the reserve roll to its dispensing position.

The leading end of sheet material on the reserve roll is self-threading into the dispensing mechanism to be led out of the dispenser to the user. This threading is assisted by the little remaining sheet material still wound on the initial roll which is still being fed through the dispensing mechanism out of the dispenser to the user. The initial roll is thus still rotated as the web of sheet material is withdrawn from it through the dispensing mechanism. When the reserve roll moves into its dispensing position it is now rotatably driven by the rotating action of the initial roll resulting from continued removal of the remainder of the web sheet material from such initial roll. The leading end of the reserve roll material moves down to meet with the remainder of material being withdrawn from the initial roll and is thereby assisted to be reliably led into the dispensing mechanism. Thereafter, webs of sheet material from both the initial roll and the reserve roll will be led from the dispenser until the sheet material on the initial roll is completely depleted whereafter the web of sheet material from the reserve roll alone will be fed through the dispensing mechanism and out of the dispenser to the user.

Having the foregoing invention summary in mind, it is a principal object of the present invention to provide a dispenser for flexible sheet material wherein multiple rolls of such material are contained within the dispenser with at least one roll being held in reserve in a non-dispensing position while the sheet material is being dispensed from an initial roll with the reserve roll being latched in such non-dispensing position until substantial depletion of the sheet material from the initial roll.

A further important object of the invention is to provide for utilization of remaining sheet material on an initial roll being dispensed to assist in automatically threading the leading edge of a reserve roll of flexible sheet material into the dispensing mechanism to be removed from the exterior of the dispenser.

Another object of the invention is to provide a multiple roll dispenser wherein latching a reserve roll in a reserve position is employed and the latching is released by camming the latching into an unlatched condition in response to sensing substantial depletion of sheet material on the initial roll whereupon the reserve roll moves to its dispensing position.

Other objects and advantages of this invention will become apparent upon consideration of the detailed description of preferred embodiments thereof, given in connection with the following drawings.

DESCRIPTION OF THE PREFERRED EMBODIMENTS

Figure 1:
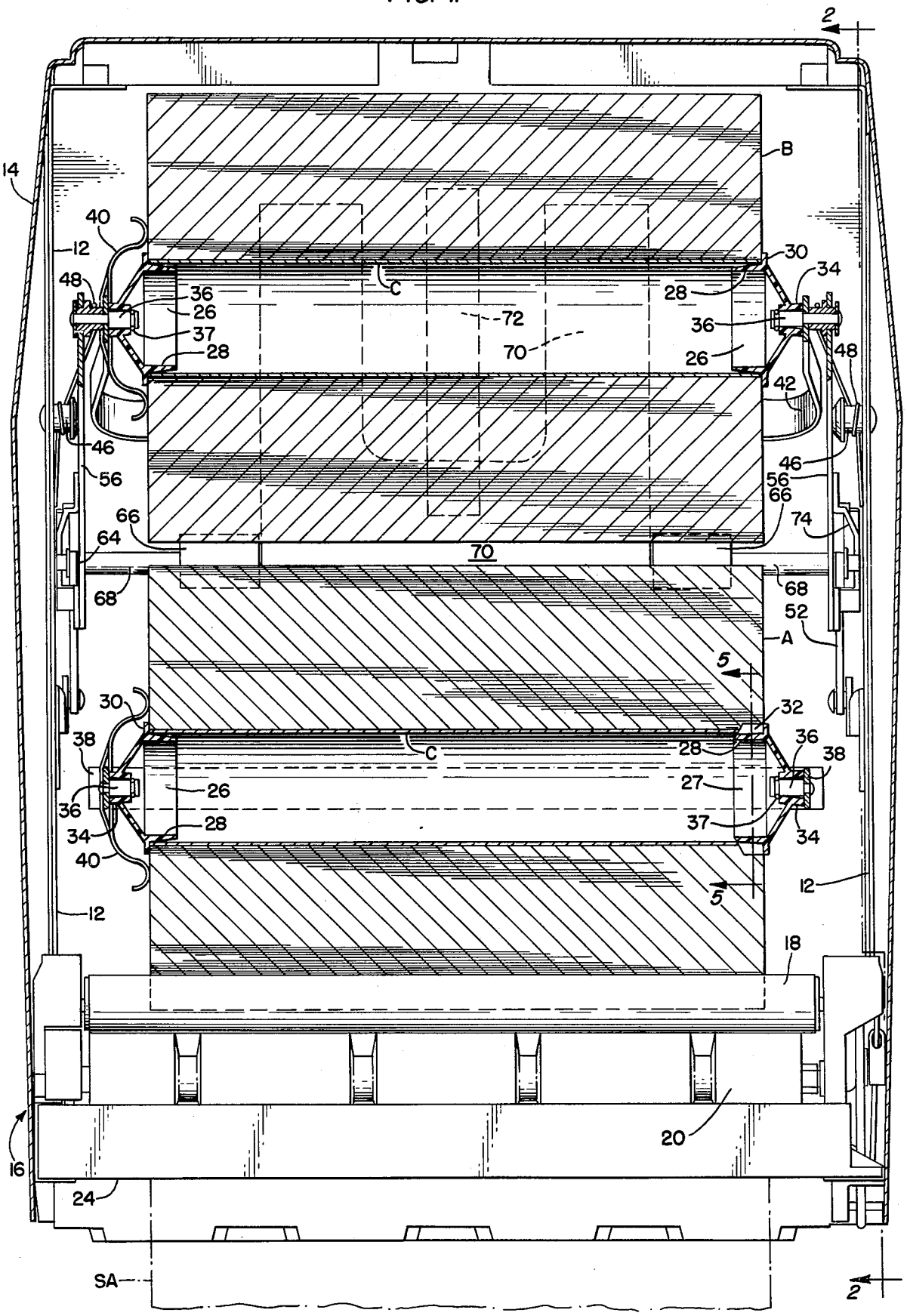
FIG. 1 is a vertical sectional view of the dispenser of the invention with the material dispensing mechanism shown in elevation.
Figure 2:
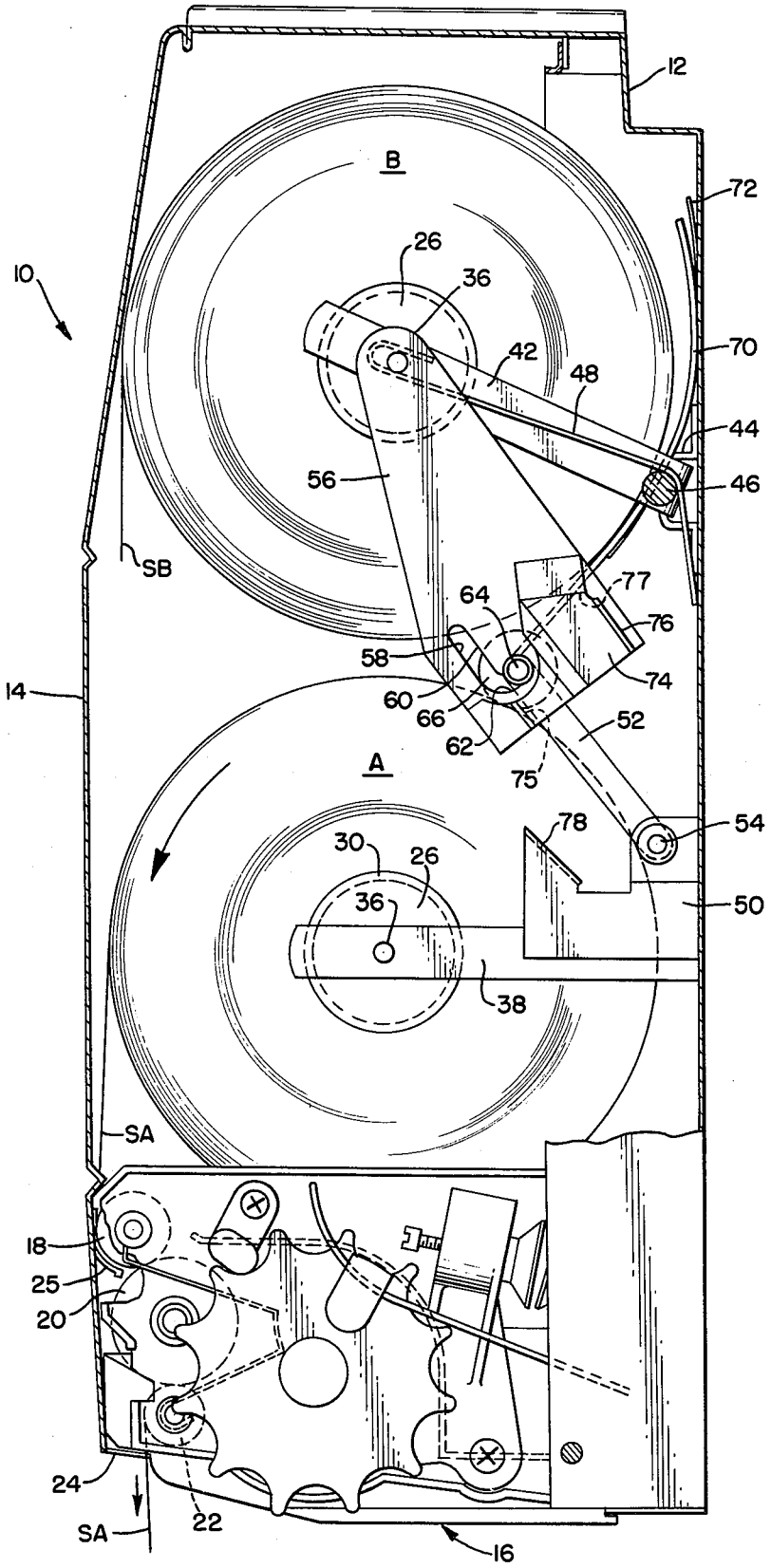
FIG. 2 is a sectional view taken on line 2—2 of FIG. 1.
Figure 7:
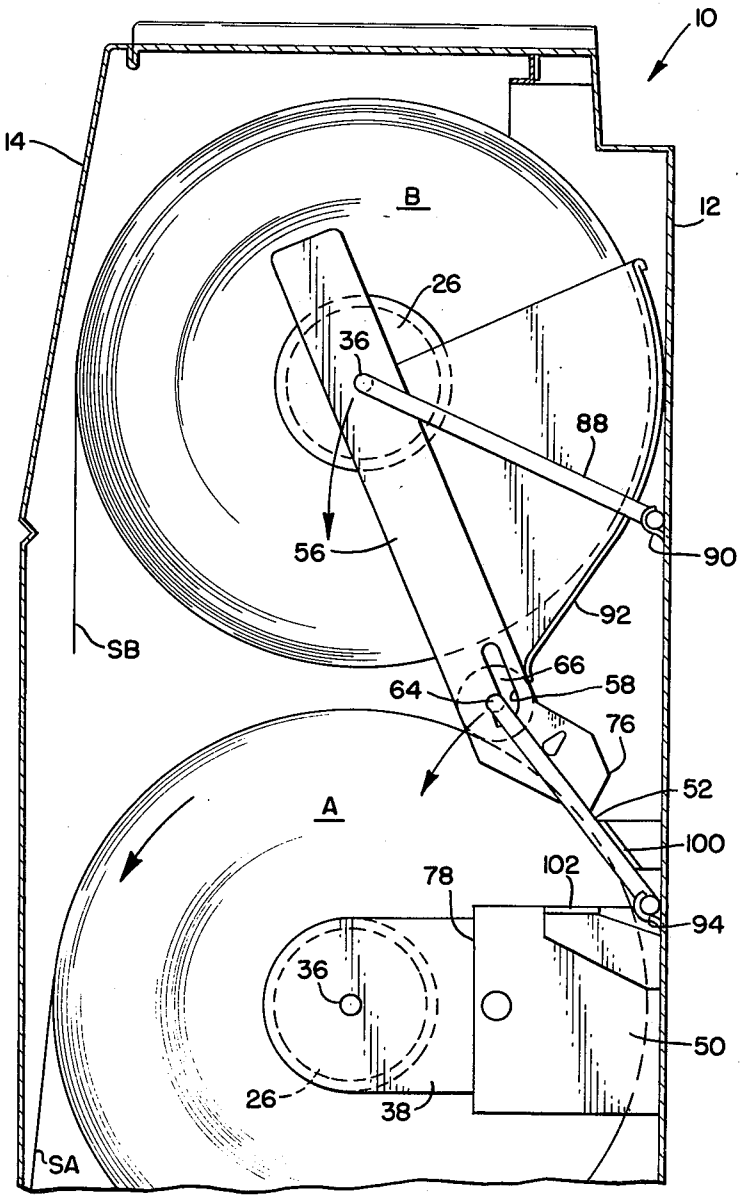
FIG. 7 is a partial elevational view, with the dispenser cabinet shown in section, showing a modified version of latching the reserve roll in its reserve position.
Figure 5:
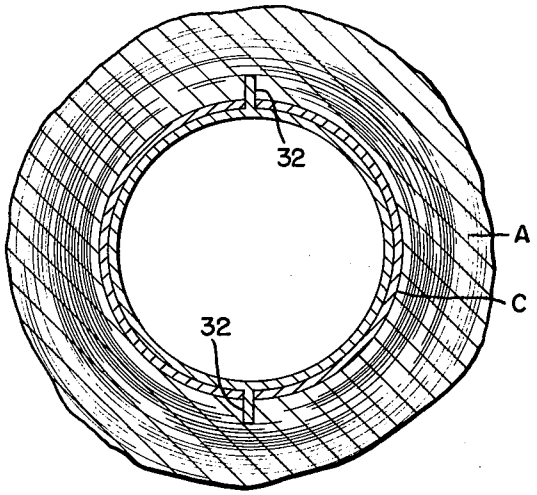
FIG. 5 is a sectional view taken on line 5—5 of FIG. 1.
Figure 6:
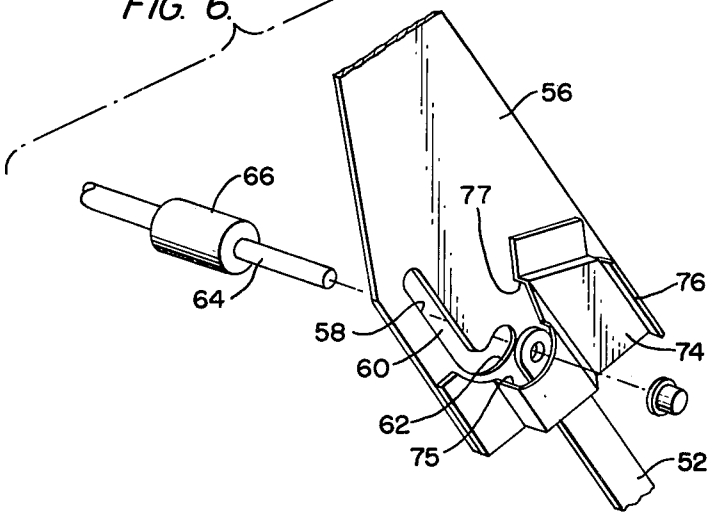
FIG. 6 is an exploded view showing portions of the parts making up one of the reserve roll latches.
Figure 9:
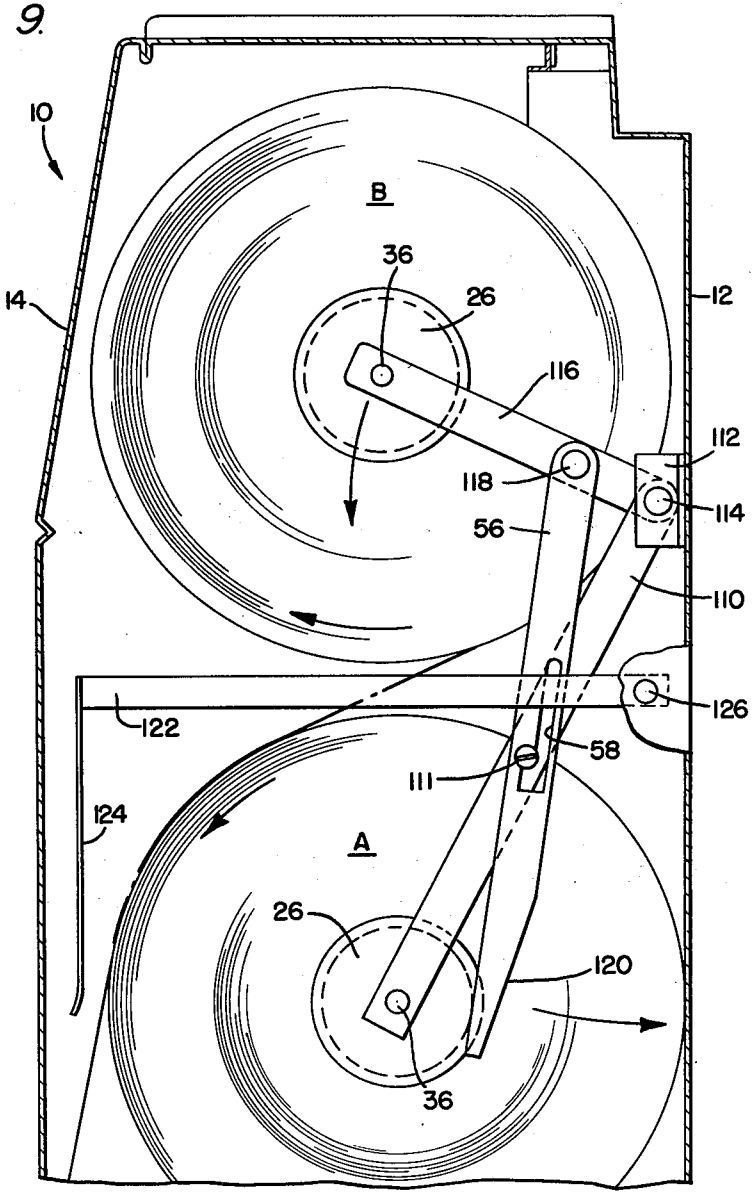
FIG. 9 is a partial elevational view, with the dispenser cabinet shown in section, illustrating a further modification of the latching to hold a reserve roll in reserve position.
Figure 8:
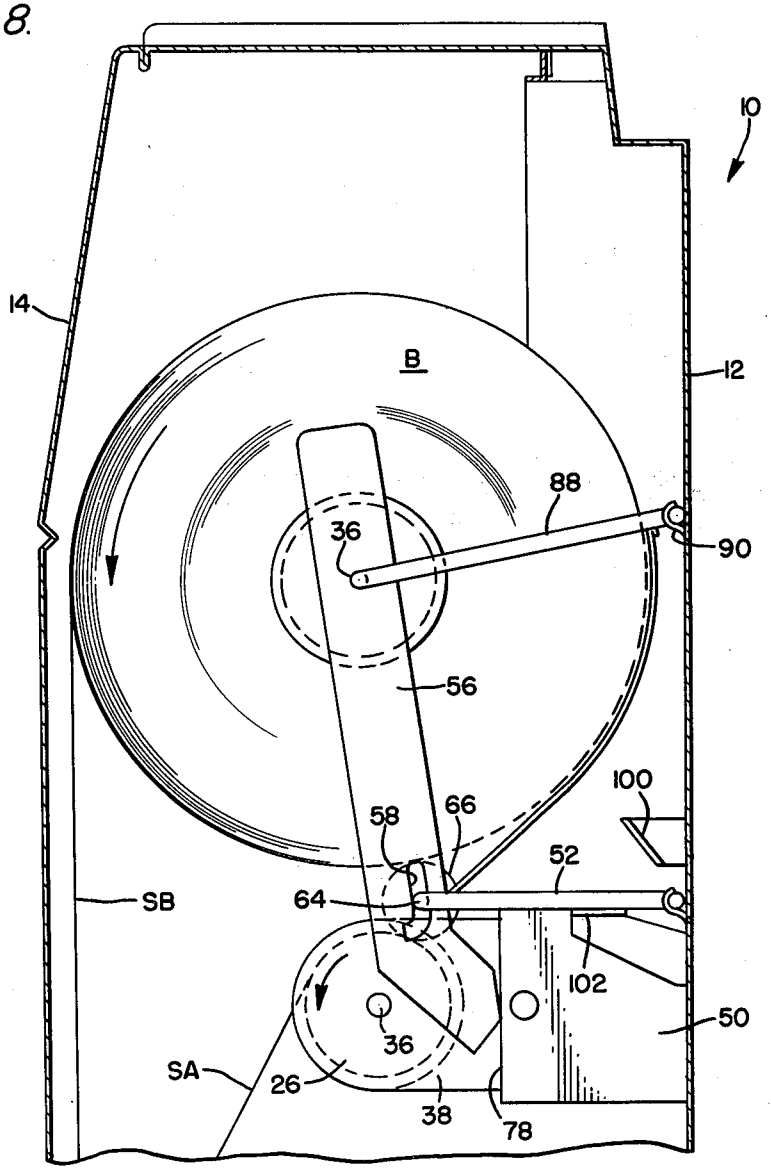
FIG. 8 is an elevational view, with the dispenser cabinet shown in section, showing the modification of FIG. 7 when the initial roll of sheet material is substantially depleted.

Reference may initially be made to FIGS. 1 and 2 which illustrate along with FIGS. 3, 4, 5 and 6 features of the preferred embodiment. FIGS. 7 and 8 illustrate a modified dispenser embodiment and FIG. 9 illustrates a further modified version of the dispenser of this invention. The three embodiments all have similar and related features in that a reserve roll of flexible sheet material such as paper toweling is held by latch means in a reserve position while an initial roll of sheet material is being used from the dispenser. Upon substantial depletion of the material on the initial roll the latching means senses such condition and is cammed to an unlatched condition whereupon the reserve roll moves to its own dispensing position to feed its sheet material into the dispensing mechanism from the dispenser.

The dispenser 10 shown in FIGS. 1 and 2 is provided with a cabinet formed by a chassis 12 adapted to be secured to a wall surface at the location desired to make paper toweling available to a user and a removable cover 14 which mates with the chassis 12. As conventional in sheet material roll dispensers, the cover 14 will be latched into cooperation with the perimeter of the chassis 12 and a locking means (not shown) will normally be provided whereby a key can be employed to release the cover from the chassis when replenishment of the rolls of sheet material in the cabinet is required.

The chassis 12 carries at its lower end a web dispensing mechanism 16. The particular dispensing mechanism 16 illustrated on FIGS. 1 and 2 need not be described in detail since it, per se, forms no part of the invention. Its construction features are fully disclosed in Jespersen, et al Reissue Pat. No. Re 28,911 issued July 20, 1976. Suffice it to state that the mechanism includes an input sheet roller 18 drivingly mating with an intermediate cutter roller 20 which in turn mates with an output roller 22. The web of flexible sheet material withdrawn from either initial roll A or subsequently from reserve roll B when the initial roll is substantially depleted and then fully depleted is threaded into the nip between rollers 18 and 20, around roller 20 and then between rollers 20 and 22 to be led out of the dispenser through an opening 24 at the bottom of the dispenser which is formed in the cover 14 forwardly of the bottom end of chassis 12. As shown in FIG. 2, the sheet material SA, being drawn from initial roll A through the dispensing mechanism 16, is exiting from opening 24 to be accessible to the user for removal from the dispenser.

A curved guide 25 is mounted on the inner wall of cover 14 curved to lie essentially concentric with the exterior of input roller 18 when the cover 14 is in place as shown in FIG. 2. This curved guide has its end disposed near the nip of rollers 18 and 20. The guide 25 acts to assist in guiding a leading end of a web of flexible sheet material down from the supplying roll A or B into the nip of the rollers to be fed through the dispensing mechanism and thence out through opening 24.

Whereas a specific dispensing mechanism mentioned hereinabove as being disclosed in Reissue Pat. No. Re 28,911 has been illustrated and mentioned as suitable for use with the invention, it is to be understood that this form of dispensing mechanism is only illustrative. Insofar as this invention is concerned, any suitable form of dispensing mechanism to guide and lead a web of sheet material from a roll to exit the dispenser may be employed.

The mounting of rolls A and B within the dispenser is best illustrated in FIG. 1. Each roll is made up of a web of flexible sheet material, such as toweling, wound onto a core C as is conventional. The core of each roll is engaged internally by cup members 26 at each roll end which serve to rotatably support the rolls within the dispenser cabinet. Each cup member as illustrated has a cylindrical externally tapering skirt 28 which snugly fits the interior of the roll core C with a flange 30 at the outer end of the skirt which rests against the outer end of the core C. In some instances a cup member 27 such as shown at the lower right end of roll A in FIG. 1 can be used employing one cup member 27 at one end of each roll. Cup member 27 is provided with radial fins 32 at diametrically opposite points on the skirt 28. These fins extend out into slots formed in the end of the roll of flexible sheet material in the manner illustrated in section on FIG. 5. These fins 32 give a positive driving between the cup member 27 and the roll where they are employed. The cup members 26 and 27 each have a cylindrical hub 34 which rotatably engages with a fixed stub shaft 36 mounted as described below.

It is to be understood that although separate cup members 26 and/or 27 are illustrated, one engaged with each end of each roll, the rotatable support for each roll within the dispenser cabinet may alternatively be provided by using a mandrel extending throughout the length of the core C and protruding from the ends of the rolls to engage with rotatable support means so that the roll can rotate in its dispensing operation.

In supporting the initial roll A, the stub shafts 36 for each end of such roll are fixedly mounted on the ends of the parallel arms of a roll supporting yoke 38. This yoke in turn is suitably secured to the back wall of chassis 12 to fixedly mount the initial roll A within the dispenser cabinet while the roll is rotatable along with the cup members 26 and 27 on the stub shafts 36 at each end of the roll.

Retaining rings 37 are provided to be held in a groove at the inner end of each stub shaft 36 to retain the cup members 26 and 27 on the stub shafts. Thus, when the rolls have been depleted and the cover 14 is removed from the chassis to reload the dispenser, the empty cores C are simply separated from the cup members 26 and 27 and new full rolls placed on these members. To enable this, the yoke 38 is appropriately constructed of resilient material such as spring metal so that the normally parallel legs of the yoke can be spread apart to space the cup members 26 and 27 away from the ends of the core C for removal of an empty core and insertion of a new roll. Then the resilient material of the yoke 38 will press the cup members 26 and 27 into ends of the core of the newly loaded roll. This spring action firmly presses the cup members 26 and 27 into the core and against the roll ends so that they rotate with the roll on the stub shafts 36.

A spring element 40 may be provided at at least one end of each of rolls A and B, this spring element 40 as shown in FIG. 1 is fixedly related to one arm of yoke 38 so as to not be capable of rotation with the roll. The ends of the spring element 40 press against the end of the roll and since element 40 is fixed they act as a brake against over unwinding of sheet material from the roll incident withdrawal of web material from the dispenser. Thus, the web of material being withdrawn from the roll is kept reasonably taut and the roll does not overspin to risk the possibility of jamming by loose loops of web material forming on the exterior of the roll.

The reserve roll B is mounted within the dispenser 10 cabinet formed by chassis 12 and cover 14 at the upper end of the cabinet on a yoke 42 which is similar to yoke 38 which supports the initial roll A. Both yokes 38 and 42 have parallel arms extending away from the inner wall of chassis 12 and both yokes are constructed of resilient material to not only resiliently press the cup members 26 and 27 against the opposite ends of the rolls but also enable these parallel legs of the yokes to be sprung outwardly for removal of an empty core and the placing of a full roll of sheet material between the cup members 26.

Figure 4:
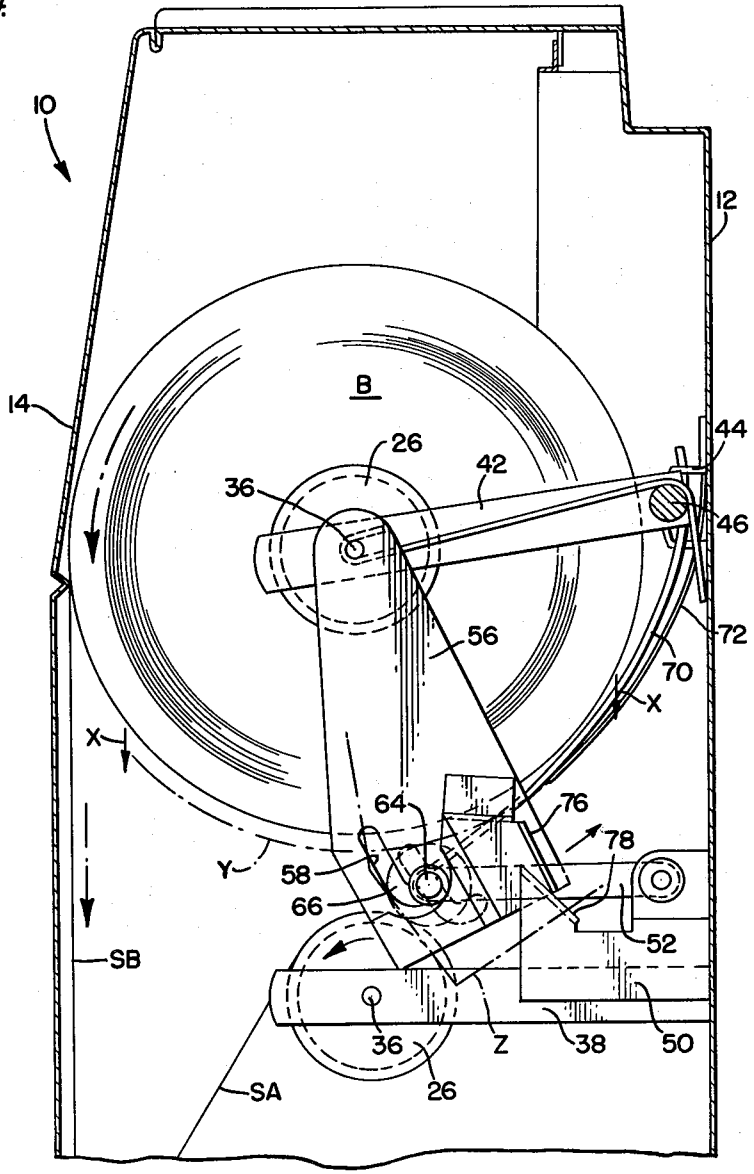
FIG. 4 is a view similar to FIG. 3 but showing the unlatching action in response to substantial depletion of the sheet material from the initial roll to release the reserve roll from its dispensing position.
Figure 3:
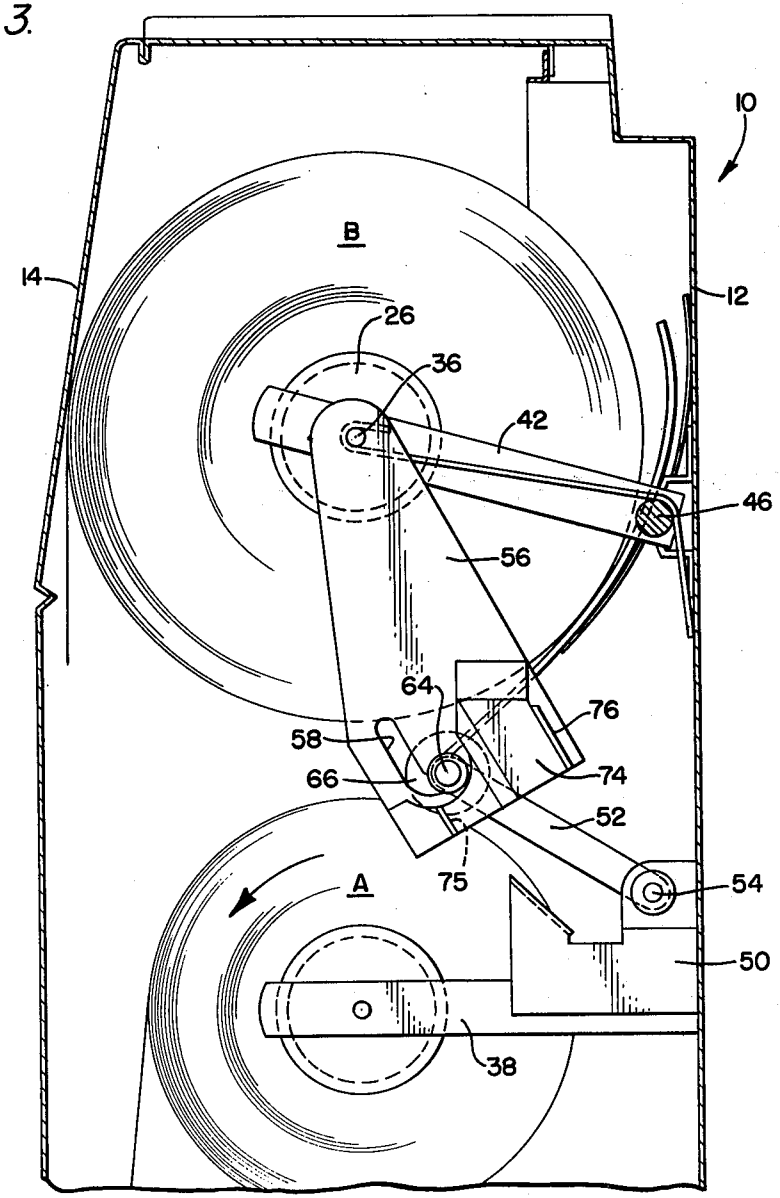
FIG. 3 is a partial elevational view, with the dispenser cabinet shown in section, showing the latched condition holding the reserve roll in reserve position with the initial roll partially depleted.

However, yoke 42 supporting roll B is not fixedly mounted to the chassis 12 but rather is secured to the chassis back wall to enable the yoke to swing about its mounting to the chassis wall. This pivotal connection of yoke 42 is shown in FIG. 2 as being provided by a bracket 44 fastened to the inner wall of the chassis 12. Bracket 44 offers a rectangular opening through which the central portion of yoke 42 extends. The central portion of the yoke connects the rear ends of the arms of the yoke adjacent the chassis inner wall. Two brackets 44 may be individually located, one near each arm of the yoke with the central yoke portion passing through the two brackets so as to be held in a loosely pivotal condition which permits the yoke 42 carrying the reserve roll B to swing from an upper position where the roll B is in a reserve position to lower positions such as shown in FIGS. 3 and 4.

The sidewalls of the chassis 12 each carry a pin 46 extending inwardly of the sidewall. Each pin carries a spring 48 which is looped around the pin and has a downwardly extending arm that presses against the inner back wall of the chassis 12. The other arm of each spring 48 extends away from pin 46 and is hooked over the outer end of the stub shaft 36 which rotatably supports a cup member 26. The function of springs 48 is to support a limited portion of the weight of the reserve roll B but still not be sufficiently strong as to prevent the roll B from moving downwardly under its own weight when it is released from its latched reserve position and moves down into its dispensing position upon substantial depletion of the web sheet material from initial roll A.

Latching mechanism is provided to retain a full reserve roll B in the uppermost reserve position within the dispenser cabinet and out of contact with the initial roll A. As such it is in a dormant condition until the latching mechanism is released upon sensing that the material on the initial roll is substantially depleted. This mechanism for the first embodiment is best shown in FIGS. 2, 3 and 4.

A bracket 50 is secured to the inner back wall of chassis 12 in the form illustrated. Of course, the bracket 50 may be connected to the sidewall of the chassis and there are two such brackets, one at each side of the chassis 12 each to be disposed adjacent the plane of the end of the reserve roll of sheet material. Each bracket has an arm 52 pivotally connected at 54 to the bracket 50. The other end of arm 52 is pivotally connected to a link 56. This link is pivotally connected at its upper end to stub shaft 36 as shown in FIGS. 1 and 2. Each link 56, at the opposite sides of the cabinet, has an L-shaped slot 58 with the long leg 60 of such slot extending longitudinally of link 56 and the short leg 62 extending perpendicular to the long leg 60 and likewise perpendicular to the length of link 56. The pivotal connection between the end of arm 52 and link 56 is formed by a shaft 64 which is rotatably mounted in a bore formed in the end of link 52 and passes through slot 58 across the width of the dispenser, through the slot 58 of the similar link 56 at the opposite side of the dispenser and then rotatably through a bore formed in the end of the link 52 at the opposite side of the dispenser. This relationship of shaft 64 is best shown on FIG. 1.

Shaft 64 carries roller means formed by a pair of idler rollers 66 freely mounted to rotate on the shaft. These idler rollers, as will become apparent from the description hereinafter, ride on the surface of the initial roll A as sheet material is withdrawn therefrom and therefore act as sensing means to sense the depletion of material from roll A. As hereinafter described, they then function to unlatch the latching means for reserve roll B when roll A is substantially depleted. To retain rollers 66 in proper spaced position along shaft 64 spacing sleeves 68 may be placed over shaft 64 adjacent each end of the shaft to keep rollers 66 from moving outwardly. Between rollers 66 and also mounted to be pivotal around shaft 64 is curved retainer 70.

This retainer 70, as seen in FIG. 2, curves around the periphery of a full reserve roll B, but has an arc of curvature greater than the curvature of the outside of reserve roll B. Retainer 70 has a leaf spring 72 which presses against the inner rear wall of chassis 12 to urge the curved guide 70 toward and into light touching contact with one point on the rear surface of reserve roll B. The curved retainer 70 resiliently urged by leaf spring 72 acts to guide the leading edge of sheet material roll B if it is located on the rear portion of roll B. Importantly, it holds the sheet material on the outside of roll B against the roll if the leading edge on the roll is at the top of the roll in the reserve position so that this edge will not accidentally fall down due to vibration or other causes incident dispensing from initial roll A. If the edge were to fall down, it could fall onto actively dispensing roll A and sheet material from roll B could be prematurely fed into the dispensing mechanism and dispensed along with sheet material coming from roll A.

Each link 56 on the opposite sides of the reserve roll B has affixed thereto facing outwardly of the link a control bracket 74. Control bracket 74, through which one arm 52 passes to be disposed between the outer surface of one link 56 and the inner surface of the control bracket, provides an abutment 75 on the inside thereof to be engaged by one edge of arm 52 and thereby prevent arm 52 and link 56 from moving excessively far in an upward direction from the relationship of these parts as shown in FIG. 2. The control bracket 74 also has an outwardly projecting wall 76 forming a cam which cooperates with a stationary cam 78 on bracket 50 as will be explained. The control bracket also can provide an abutment wall 77 on the inside thereof which is engaged by the opposite edge of arm 52 when the reserve roll B is released from its latched condition and moves downwardly. This abutment wall 77 limits the downward extent of movement of the reserve roll B.

In operation of the first embodiment, the dispenser cabinet is loaded with two full rolls of flexible sheet material such as paper toweling, one an initial roll A and the other a reserve roll B. The cover 14 is secured to chassis 12 to complete the dispenser 10 cabinet whereupon the curved guide 25 is positioned to guide sheet material into the nip of rolls 18 and 20. Of course, with the cover 14 removed, the web material of roll A may be manually threaded into the nip of rolls 18 and the dispensing mechanism actuated to place the threaded end of the sheet SA outside and below opening 24. Preferably, the end SB of the sheet material wound on roll B is positioned as shown in FIG. 2 in readiness for the self-threading operation which occurs when initial roll A is substantially completed, although this locating of end SB is not necessary to getting effective self-threading of the web from roll B at the proper time.

With the dispensing cabinet loaded, the condition as shown in FIGS. 1 and 2 exists, the idler roller 66 are resting on the outer surface of roll A and will accordingly be driven to rotate in accordance with the rotation of roll A when sheet material on roll A is dispensed from the dispenser. In this relationship the shaft 64 is located in the short legs 62 of the L-shaped slots 58 in the two links 56 located adjacent the opposite ends of roll B so that the position of arms 52 extending essentially in line with the length of links 56 forms a latch mechanism to hold the yoke 42 in the uppermost location and the reserve roll B carried thereby in its reserve position. It will be noted that the lower edges of arms 52 will, at this stage, be engaging abutments 75 of control bracket 74, so that links 56 and arms 52 cannot buckle upwardly from the position shown in FIG. 2.

With the apparatus in the condition as shown in FIG. 2, the engagement of shaft 64 in the short arm 62 of the L-shaped slots 58 of links 56 keeps the reserve roll B held upwardly by the longitudinal relationship of arms 52 and links 56. Rollers 66 resting against the surface of initial roll A act as a sensing means to sense when the roll A is substantially depleted. As sheet material is used from roll A, the rollers 66 follow the lessening diameter of roll A and arms 52 swing downwardly such as shown in FIG. 3 where roll A is partially depleted. In FIG. 3, the shaft 64 remains in the short arms of the L-shaped slots 58 and links 56 continue to hold the roll B in an upper reserve position since the rollers 66 on shaft 64 hold the links in this condition.

Referring to FIG. 4, the sheet material has been substantially depleted from roll A. Just before this substantial depletion occurs, the cam wall 76 engages with stationary cam 78 carried on fixed bracket 50. As the depletion of roll A approaches the substantial depletion point, the interengagement between elements 76 and 78 tends to cam link 56 in a counterclockwise direction as shown by the arrow on FIG. 4. Since the position of shaft 64 is fixed by reason of arms 52 holding the shaft relative to brackets 50 on chassis 12, the shaft 64 is moved progressively out of the short arms of slots 58 toward the lower end of the long arms of such slots. When the point of substantial depletion of roll A is reached, the counterclockwise camming of links 56 has progressed to the point where shaft 64 passes into the long arms of slots 58. Thereupon links 56 become unlatched from the retaining action of shaft 64 on arms 52. The reserve roll B thus moves downwardly in the direction of arrows X on FIG. 4 to a position shown by the broken line Y. Shaft 64 retains its position with rollers 66 continuing to rest and be rotatably driven by the remaining sheet material on roll A as it is withdrawn from the dispenser. The links 56 assume the broken line position Z shown in FIG. 4 with shaft 64 disposed upwardly in the long arms of slots 58 in links 56.

With roll B now lowered to have its periphery at the broken line Y position, it now also is resting on an upper portion of idler rollers 66. Thus, as the remaining sheet material is withdrawn from initial roll A rotation of rollers 66 thereby transmits and applies rotating motion to reserve roll B, feeding the leading end of sheet material SB downwardly toward the dispensing mechanism 16 with the roll rotating counterclockwise in the direction shown by the arrow on roll B in FIG. 4.

As the leading end off of roll B passes downwardly at a point it will engage with the remaining sheet material being drawn off of initial roll A. The two layers of material then pass together down along curved guide 25 into the dispensing mechanism 16 and the leading end of the reserve roll passes with the remaining paper from the initial roll into the nip of rollers 18 and 20 whereupon both layers are fed out of opening 24 to the dispenser exterior.

This dispensing of two layers of sheet material continues only so long as the remaining web of sheet material is being drawn off of initial roll A. When roll A is fully depleted, then there will remain only the dispensing of web SB from the former reserve roll B which is now in its own dispensing position. The core C of roll A with remain empty. After a porton of roll B has been removed, the roll's diameter will be reduced and the surface of this roll will be remote from the surface of rollers 66. Then these rollers will thereafter no longer be driven by any rotation of roll B.

After the sheet material on the former reserve roll B has been depleted the two empty cores C for former rolls A and B will remain on the cups 26 and 27 which originally supported them and the rolls. When the reserve roll B is exhausted or removed from yoke 42, the springs 48 will lift yokes 42, links 56, arms 52, shaft 64 and idler rollers 66 to the upper portion of the dispenser cabinet. This shifts shaft 64 back down the long slot arms and into the short arms 62 of slots 58, thereby cocking the latching mechanism into readiness to receive a new full reserve roll at the upper reserve position within the dispenser cabinet.

The cabinet cover 14 is then opened to reload, the empty cores C are removed and two new full rolls are placed on the rotating supports for the reserve roll and initial roll.

A different embodiment of the invention is illustrated in FIGS. 7 and 8. This embodiment has a similar mode of operation as will become apparent from the description of the construction employed for the dispenser. Accordingly, it is not believed that full repetition of the operation as set forth for the dispenser construction illustrated in FIGS. 1 through 6 need be repeated. Likewise, for simplicity and to avoid duplication in describing the parts in FIGS. 7 and 8 where the parts or elements are similar to those of the first embodiment, the same reference numerals will be used for this embodiment.

The dispenser 10 cabinet is made up of a chassis 12 and cover 14 as in the previously described embodiment. Initial roll A is carried on a yoke 38 with the roll being supported on suitable stub shafts 36. The reserve roll B is rotatably supported on a yoke 88. Yoke 88 has its central portion parallel to the back wall of chassis 12 extending through an opening in link 56, through one cup member 26, on through the center of the core of roll B then through another cup member 26 at the opposite end of roll B and through the opening in the other link 56. Two arms extend rearwardly toward the back wall of chassis 12 from the opposite end of this central portion. The rearwardly disposed ends of these arms are each bent outwardly at approximately 90° to each arm for the ends to be rotatably retained in semi-circular retaining members 90 carried by the back wall of chassis 12.

A curved retainer 92 having a function similar to the retainer 70 of the earlier described embodiment is provided at the rear of reserve roll B.

An arm 52 is pivotally connected to semi-circular retaining member 94 carried by the back wall of chassis 12 by its rearward end being bent outwardly to cooperate wih retaining member 94. This arm 52 with a similar arm 52 at the opposite end of roll B forms a yoke having a central portion extending through an L-shaped slot 58 in link 56 and then extending across the width of the dispenser forming a shaft 64 which carries idler rollers 66, this central portion extending through a slot 58 in a link 56 at the opposite end of roll B. The other arm 52 at the opposite end of roll B has its rearward end pivotally connected to the back wall of chassis 12 by a retaining member similar to member 94. A cam wall 76 forming a cam is provided at the lower end of link 56.

Limit stops 100 carried by the back wall of chassis 12 set the uppermost swing point for each arm 52 whereas limit stops 102 determine the lowermost swinging position of each arm 52 which are shown in FIG. 8. Bracket 50 mounted on the back wall of chassis 12 carries a cam 78.

As previously mentioned, the operation of this second embodiment is very similar to that of the previously described embodiment. The arms 52 and links 56 at the opposite ends of roll B latch this roll in its reserve position when the portion forming the shaft 64 which carries the rollers 66 is located in the short leg of L-shaped slots 58. The rollers 66 follow the depletion of sheet material from initial roll A and thus move downwardly with arms 52 swinging downwardly toward abutment 102 while shaft 64 remains in the latched position by being in the short legs of L-shaped slots 58. When the initial roll A is substantially depleted, the cam wall 76 rides downwardly along cam 78, shifting the links 56 clockwise. Again, the arms 52 hold the shaft 64 at a fixed distance relative to the rear wall of the chassis 12 and the links 56 move to dispose shaft 64 out of the short arms into the long arms of L-shaped slots 58 whereupon the reserve roll B moves downwardly into engagement with and be driven by the rollers 66 that are rotated as the remaining sheet material is drawn off of the core of roll A. The rest of the operation is lowering and leading sheet material from roll B into the dispensing mechanism along with the remainder of sheet material being taken from initial roll A is identical to that described for the previous embodiment.

A further embodiment is shown in FIG. 9. As in the case of the previous two described embodiments, similar reference numerals will be used where appropriate on the embodiment of FIG. 9, as were used on the two previously described embodiments. The one difference that might be noted is that in the embodiment of FIG. 9, the sheet material is taken from the reserve roll B by being drawn from the underside with the roll rotating clockwise where as in the previous two embodiments the sheet material was drawn over the top of the roll B with the roll rotating counterclockwise.

The dispenser cabinet is formed by a chassis 12 and cover 14 as in the previous embodiments. The initial roll A in FIG. 9 is rotatably supported on stub shafts 36 carrying cup members 26 which engage with the core and ends of the roll A. The stub shafts 36 are carried on a pair of parallel arms 110 each of which carries a latch pin 111 fixed to the arm along its length. Arms 110 extend upwardly and are pivotally mounted on brackets 112 secured to the rear wall of the chassis 12. These brackets carry pins 114 that pivotally mount the arms 110 at oppposite sides of the interior of the dispenser cabinet.

The reserve roll B is pivotally supported on stub axles 36 which rotatably engage with cup members 26 that mate with the ends of the core and roll B as in the previous embodiments. The stub shafts are carried on arms 116 which in turn at their rear ends are pivotally connected to the brackets 112 by means of pins 114. Thus, the arms 116 function in the same manner as the arms of yoke 42 in the first embodiment or yoke 88 in the embodiment of FIGS. 7 and 8. Likewise, the arms 110 function similar to the supporting yoke 38 for the initial roll A in the first two embodiments although arms 110 do not stationarily support the roll A as is the case in the earlier two embodiments. Links 56 are pivotally connected on each side of the roll B on pins 118 carried by each arm 116 that carries the reserve roll B. Each link has an L-shaped slot 58 having a short leg and a long leg, the latter extending longitudinally of link 56 and the former transversely of the link. A latching pin 111 on each arm 110 engages in the L-shaped slot 58 of link 56. The lower end of link 56 has a cam wall 120 forming a cam.

As previously noted, the sheet from roll A passes across the top on the FIG. 9 embodiment similar to that of the previous two embodiments. However, the feed from roll B is taken from the underside of this roll as shown in FIG. 9.

A guide 122 carrying resilient downwardly extending spaced guide fingers 124 is pivotally connected at its rearward ends on pins 126 carried by the sidewalls of chassis 12.

Since the initial roll A is pivotally connected by pins 114 and arms 110 it swings on arms 110 so that its peripheral surface engages the inner wall of the back of chassis 12 all during dispensing from roll A.

With a latching pin 111 on each arm 110 engaged in the short arm of L-shaped slot 58 of each link 56, the reserve roll B is held in its upper reserve position by reason of links 56 being pivotally connected by pins 118 to the arms 116 carrying the reserve roll B. As the sheet material on roll A is depleted, the inner rear wall of the chassis 12 acts to sense this depleting action and the initial roll A axis formed by stub shafts 36 moves rearwardly toward the chassis rear wall since the arms 110 are free to pivot toward this wall on pins 114. As the substantially depleted state of the sheet material on roll A approaches, the cam walls 120 on links 56 will have moved back toward the chassis back wall and when the substantial depletion point is reached for an initial roll A, the cams engaged with the chassis rear wall will act to swing links 56 about pins 118 thereby moving the L-shaped slot 58 until the latch pins 111 enter the longitudinal arm of slots 58. At this point, the latching performed by links 56 will be unlatched and reserve roll B will swing downwardly under its own weight to engage the surface of initial roll A which now has only a small remaining portion of sheet material thereon.

As in the previous two embodiments, continued removal of sheet material from roll A will now impart rotation to roll B by the surfaces of the two rolls being in engagement with each other. Initial roll A will rotate counterclockwise and in turn, by the driving engagement between the two rolls, this will rotate reserve roll B in a clockwise direction feeding a web of sheet material onto the remaining sheet material being taken from roll A. The two webs from the two rolls will be led down under the guidance of the spring fingers 124 on guide 122 onto the curved guide 25 and into the nip of the rollers 18 and 20, thence through the feeding mechanism 16 to be led out through opening 24 in the same manner as the operation carried out in the previously described two embodiments.

It will be understood that in disclosing the three embodiments illustrated on the drawings and described hereinabove, it is contemplated that very many variations and changes or different constructions may be employed in utilizing the invention other than those shown and described herein. These variations, changes and modifications are contemplated to be within the scope of the concept of the invention. Accordingly, it should be realized that the scope of the invention is not limited by the description and the illustrations presented in this application, but is governed only by the scope of the appended claims.

We claim:

1. A dispenser for flexible sheet material comprising:

a chassis adapted to be attached to a wall at a location for flexible sheet material use, means secured to said chassis for rotatably supporting an initial roll of flexible sheet material in a dispensing position to supply a web of said material from said initial roll, support means for rotatably supporting a reserve roll of flexible sheet material in a reserve position spaced from the dispensing position for the initial roll, said support means being pivotally connected to said chassis to enable said support means to swing between the reserve position to a dispensing position for the reserve roll, latch means connected to said support means having a latch condition for holding the reserve roll carried by the support means in the reserve position and an unlatch condition permitting the support means to swing about its pivotal connection to the chassis and carry the reserve roll to the dispensing position for the reserve roll, said latch means while in said latch condition being operable to gradually move the support means from an upper extermity of the reserve position to a lower extermity of the reserve position just above the dispensing position for the reserve roll, said movement being responsive to gradual depletion of the flexible sheet material of the initial roll so that when the latch means disengages from the latch condition to the unlatch condition, the support means swings only a relatively short distance to move the reserve roll from the reserve position to the dispensing position for the reserve roll, cam means carried by said chassis engageable with said latch means to disengage the latch means from said latch condition to said unlatch condition when the flexible sheet material of the initial roll is substantially depleted, and means operatively connected to said chassis for guiding a web of flexible sheet material successively from each of said rolls out of the dispenser to be accessible to a user.

2. A dispenser as recited in claim 1 wherein said means for rotatably supporting an initial roll disposes the roll axis in a fixed position relative to the chassis.

3. A dispenser as recited in claim 1 wherein said means for rotatably supporting an initial roll includes roll holding means mounted on support arms pivotally connected to said chassis.

4. A dispenser as recited in claim 3 wherein said arms form a part of the latch means for holding the reserve roll in the reserve position.

5. A dispenser as recited in claim 1 wherein said means for guiding the web out of the dispenser includes pinch rollers for gripping the web and a curved guide member adjacent said rollers positioned to direct the web into the nip of said pinch rollers.

6. A dispenser as recited in claim 1 wherein said support means for a reserve roll comprises a yoke having generally parallel arms extending outwardly from said chassis with roll holding means disposed adjacent the outer ends of said parallel arms and the base of said yoke at the opposite ends of said parallel arms is pivotally secured to said chassis.

7. A dispenser as recited in claim 1 wherein said latch means includes a link having an L-shaped slot formed therein pivotally connected to said support means for a reserve roll, and retaining means engages one leg of said slot to hold the latch means in the latch condition and engages the other leg of said slot for the latch means to be in the unlatch condition.

8. A dispenser as recited in claim 7 wherein said cam means is engageable with said link to move the L-shaped slot in the link to disengage said retaining means from said one leg of said slot into the other leg of said slot to achieve said unlatch condition.

9. A dispenser as recited in claim 7 wherein said retaining means is carried on arms which are pivotally connected to said chassis.

10. A dispenser as recited in claim 9 wherein said arms rotatably support an idler roller therebetween which is to ride on the surface of the initial roll to sense the extent of depletion of flexible sheet material from such roll.

11. A dispenser as recited in claim 9 wherein said arms also form said means for rotatably supporting an initial roll.

12. A dispenser as recited in claim 1 wherein said cam means is provided by an abutment mounted on said chassis.

13. A dispenser as recited in claim 1 wherein said cam means is provided by a wall surface of said chassis.

14. A dispenser as recited in claim 1 wherein an idler roller is rotatably mounted to ride on the surface of the initial roll and be driven by rotation of the initial roll, said idler roller being positioned generally between the initial and reserve rolls so that upon cammed disengagement of said latch means to said unlatch condition the reserve roll will move into engagement with said idler roller to be driven in the same direction as the initial roll during removal of the remaining flexible sheet material from the initial roll.

15. A dispenser as recited in claim 4 wherein said cam means is provided by a wall surface of said chassis and upon cammed disengagement of said latch means to said unlatch condition the reserve roll moves into engagement with the surface of the initial roll to be driven in the opposite direction from the initial roll during removal of the remaining flexible sheet material from the initial roll.

16. A dispenser as recited in claim 1 wherein spring means is provided connected between said chassis and said reserve roll support means acting in a direction to partially counterbalance the weight of the reserve roll carried by said support means and urge said support means upwardly in the absence of a reserve roll.

17. In a dispenser for flexible sheet material having an initial roll of sheet material, a reserve roll of sheet material and mechanism to advance sheet material from the rolls out of the dispenser, a method for feeding a web from the reserve roll through the dispenser following substantial depletion of the web of the sheet material from the initial roll comprising the steps of:

holding the reserve roll suspended a relatively short distance above the roll being dispensed, permitting the reserve roll to gradually move downwardly without rotation as the initial roll diminishes in diameter so that the space between the two rolls remains substantially constant until the supply roll is substantially exhausted, dropping the reserve roll onto a rotative portion and, rotating the reserve roll by said rotative portion as additional material is withdrawn from the initial roll to feed the web of the reserve roll out of the dispenser.

* * * * *